US006669603B1

(12) United States Patent
Forcillo

(10) Patent No.: US 6,669,603 B1
(45) Date of Patent: Dec. 30, 2003

(54) STATIONARY EXERCISE BICYCLE

(76) Inventor: Johnny Forcillo, 63 Pointe Langlois, Laval, Quebec (CA), H7L 3J4

( * ) Notice: Subject to any disclaimer, the term of this patent is extended or adjusted under 35 U.S.C. 154(b) by 354 days.

(21) Appl. No.: 09/696,948

(22) Filed: Oct. 27, 2000

Related U.S. Application Data

(63) Continuation of application No. 09/263,858, filed on Mar. 8, 1999, now abandoned.

(51) Int. Cl.[7] ..... A63B 69/16
(52) U.S. Cl. ..... 482/57; 482/51; D21/667
(58) Field of Search ..... 482/51, 57, 63–65; D21/667

(56) References Cited

U.S. PATENT DOCUMENTS 2,783,044 A * 2/1957 Sbarra ..... 482/60
4,323,237 A * 4/1982 Jungerwirth ..... 482/5
D291,462 S * 8/1987 Aalto ..... D21/667
D382,925 S * 8/1997 Wu ..... D21/667
6,099,440 A * 8/2000 Schurter et al. ..... 482/63
6,491,606 B1 * 12/2002 Swift ..... 482/57

* cited by examiner

*Primary Examiner*—Nicholas D. Lucchesi
*Assistant Examiner*—Tam Nguyen
(74) *Attorney, Agent, or Firm*—Don W. Weber

(57) ABSTRACT

The invention is directed to a stationary bicycle which has load-providing components allowing for fine-tuned adjustment of the selected load. The load providing components are made of relatively simple mechanical components so as to increase the reliability, reduce the maintenance and provide a relatively smooth cycling feel. In addition, the invention is directed to a stationary bicycle which is manufactured using specific materials and processes so as to provide for a reliable product having a relatively long life cycle characterized by reliable functioning. Furthermore, the stationary bicycle of the invention comprises a design which allows for ergonomic fine tuning of the relative positioning between the various components thereof so as to provide ergonomic adjustments thereby reducing the risk of injury to the body of the individual and allowing for a more efficient workout.

7 Claims, 4 Drawing Sheets

STATIONARY EXERCISE BICYCLE

This is a continuation of application Ser. No. 09/263,858, filed Mar. 8, 1999 now abandoned.

BACKGROUND OF THE INVENTION

1. Field of The Invention

The present invention relates to the field of exercise equipment, in general, and to an improved stationary exercise bicycle, in particular.

2. Prior Art

Relatively recent trends towards physical fitness awareness have led to an increase in the number of individuals exercising on a regular basis in order to keep physically fit. Several types of exercise equipment are currently in use to provide exercise to persons who wish to keep physically fit without venturing outdoors. One of the most popular of such indoor exercise devices is the stationary exercise bicycle.

A number of present day gymnasiums and exercise clubs have some type of stationary exercise bicycle apparatus whereby a person pedals a simulated bicycle as a form of exercise. Early exercise bicycles included apparatus designed to support a conventional bicycle so that the rear wheel thereof can rotate against a frictional load. These types of devices fall into several general categories, the first of which connects the front axle and the bottom bracket of the bicycle to a frame in order to support the bicycle. The rear wheel drives against a roller, which in turn is connected to a loading mechanism. Typically, the rear wheel drives a flywheel and a variable resistance load. A second type of apparatus used with a conventional bicycle supports the rear wheel, either on a pair of rollers or by a fixed support at the rear axle. Each of the above devices has numerous drawbacks for use as an exercise device.

The devices using a bottom bracket support allow the use of a real bicycle frame but fail to provide a realistic resistance and ride simulation. This type of equipment usually has one roller contacting the rear wheel. The devices using one or more rollers to support the rear wheel have stability and slippage problems. If the roller is behind the rear axle, the roller must be relatively long because the wheel wobbles and moves sideways and frequently falls off the roller. Conversely, if the roller is in front of the axle, the wheel stays centered but does not maintain adequate contact during periods of maximum torque on the rear wheel. In both cases, if a realistic resistance is applied, the rear tire slips on the roller.

For example, during maximum performance periods, the bicycle rider is not on the saddle, but is leaning over the handlebar and, essentially, standing on the pedals. As the weight of the rider shifts forward, the force on the rear wheel decreases and the weight on the front wheel increases, causing slippage of the rear wheel. Further, in this position with a bicycle on the bottom bracket support, the bicycle frequently pivots about the bottom bracket, effectively removing the rear wheel from contact with the supporting roller or rollers. Thus, just when the maximum resistance is needed to prevent slippage at the rear wheel, the rear wheel is at minimum friction contact with the resistance rollers and, therefore, slips.

More sophisticated bicycle simulating equipment has been developed through the years leading to current stationary bicycle designs which sometimes do not resemble standard bicycles at all. These devices consist primarily of bicycle cranks driven by the feet of the exerciser and are drivingly coupled, usually by a chain drive, to a flywheel to provide resistance to the pedal motion thereby providing the exerciser with a force to work against. Both the appearance and the functional features of the exercise bicycle are continuously undergoing change and improvement. However, they still suffer from several drawbacks The drawbacks associated with more sophisticated stationary bicycle devices include relatively complex load providing components thus inherently increasing the overall production cost of the bicycle and the need for maintenance and repair. Also, most prior art stationary bicycles use weighted flywheels that eventually create a balancing problem preventing the user from obtaining a smooth ride potentially leading to injury by micro-trauma to various body structures.

Also, most prior art stationary bicycles allow for size and configuration adjustment only by incremental units which are in the range of 1'. Consequently, optimal customization to an individual's characteristics is virtually impossible thus, again, potentially leading to injury to various body structures such as joints and ligaments. In addition, the adjustment providing mechanisms of most prior art stationary bicycles are either mechanically complex or unreliable thereby leading to high production cost, susceptibility to break down, or both.

Still further, most prior art stationary bicycles include frames made of standard forged steel which are assembled by a welding process. Typically, the frame is painted with a powder coat baked at approximately 400 degrees. This type of frame and associated paint covering may potentially lead to frame warping and reduced longevity because of rust or other deteriorating process.

Most prior art stationary bicycle devices have tried to provide a realistic simulation of a smooth ride and load resistance experience when riding a bicycle.

However, the previous attempts to accurately replicate or simulate these various load effects have all had their drawbacks. Typical load variables can include wind resistance, whether the rider is going up hill or down hill, the inertia of the rider and bicycle, the friction inherent in the bicycle itself and the frictional resistance between the bicycle tires and riding surface. Proper simulation of realistic load resistance involved providing the intended ride with the ability to fine-tune by relatively small increments the load applied to the pedals of the stationary bicycle.

For example, the effective wind resistance has been simulated by rotating fan blades, which are mechanically coupled to the rotational speed of the bicycle wheel. While the rotating fan blades can provide a force that increase as the square of the rotational speed of the fan blades, these fans are noisy, inaccurate, not readily adjustable and cannot be adjusted to account for variation in wind resistance that will occur with riders of different size and weight.

Similar prior devices have attempted to simulate the amount of load to be applied by either a mechanical or electronic brake system. A typical mechanical brake involves a friction belt that wraps around a moving surface to cause a frictional drag on that rotating surface depending upon the tension of the belt. Typically, the friction belt is positioned within a grooved formed on the peripheral surface of a flywheel. These mechanical systems, however, cannot be accurately calibrated, have a slow response time and are subject to load variations over time as the elements of the mechanical system go out of adjustment and alignment. Further, the frictional load varies with the environmental temperature and with the temperature of the frictionally engaging parts.

The prior art mechanical systems, thus, have poor repeatability, high variation in drag and are difficult or impossible to accurately calibrate to a given load. Further, a large force is typically required to be exerted on the friction belt in order to adequately vary the frictional loads. Still further, prior art mechanical systems are not provided with emergency braking functions allowing a given rider to quickly immobilize the flywheel or other mechanisms linked to the pedal in the event that an emergency situation arises.

Electronic prior art braking systems have some advantages over the mechanical systems, but the accuracy of the simulated ride depends upon several factors, including how accurately the system can be calibrated and the realism of the program with which the electronic brake is varied. Furthermore, these systems are typically much more complex than mechanical systems and, hence, considerably more expensive. Furthermore, they often require costly maintenance and repair. Accordingly, there exists a need for an improved stationary bicycle.

SUMMARY OF THE INSTANT INVENTION

The invention is directed to a stationary bicycle which has load-providing components allowing for fine-tuned adjustment of the selected load. The load providing components are made of relatively simple mechanical components so as to increase the reliability, reduce the maintenance and provide a relatively smooth cycling feel.

In addition, the stationary bicycle is manufactured using specific materials and processes so as to provide for a reliable product having a relatively long life cycle characterized by reliable functioning.

Furthermore, the stationary bicycle described herein comprises a design which allows for ergonomic fine tuning of the relative positioning between the various components thereof so as to provide ergonomic adjustments which can reduce the risk of injury to the body of the individual using the device and, thereby, allowing for a more efficient workout.

DESCRIPTION OF A PREFERRED EMBODIMENT

Figure 1:
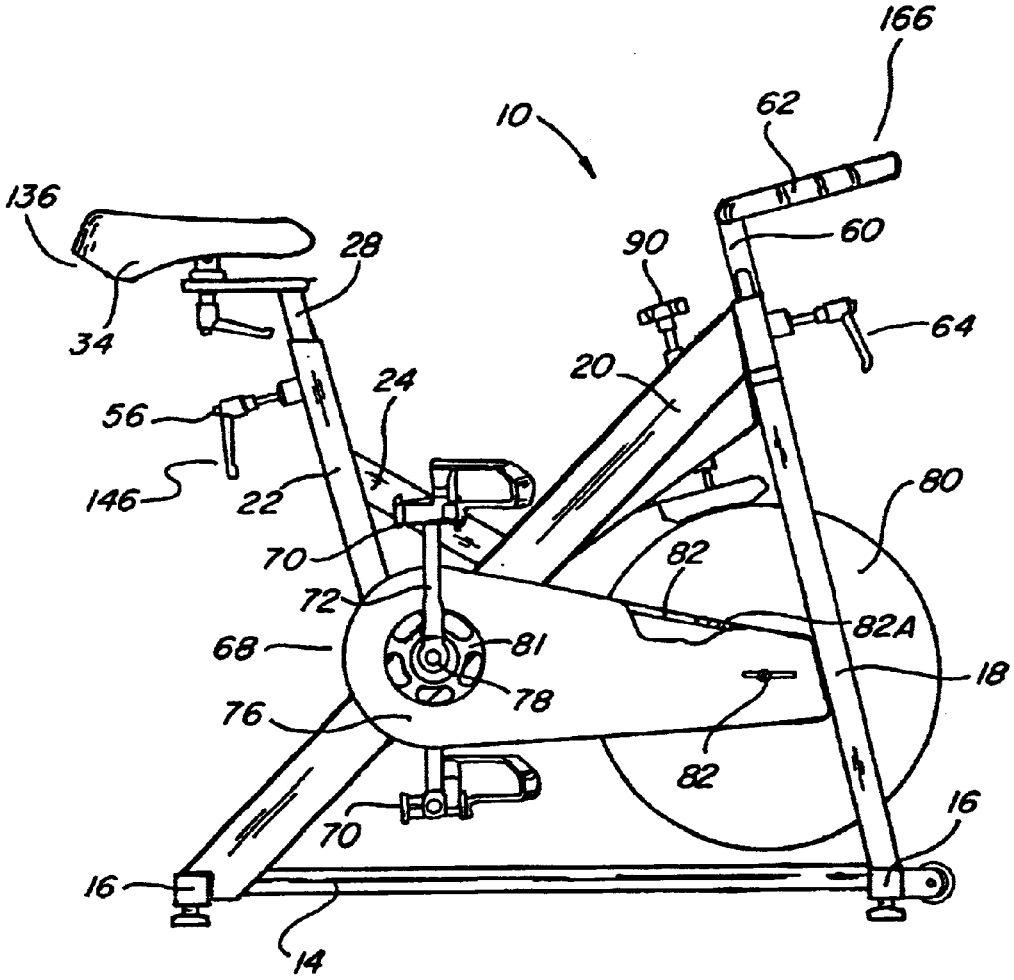
FIG. 1 is an elevation view of one embodiment of a stationary exercise bicycle in accordance with the present invention.

Referring now to FIG. 1, there is shown, in an elevation view, a stationary exercise bicycle 10 in accordance with a preferred embodiment of the present invention. The bicycle 10 has a frame which includes a base section 12 which includes a base longitudinal tube 14 and a pair of base transversal tubes 16. The transversal tubes 16 are rigidly attached to the base longitudinal tube 14, typically, at opposed ends thereof. A front support tube 18 extends upwardly from the base longitudinal tube 14 adjacent the first end thereof. The front support tube 18 is, preferably, angled relative to the base longitudinal tube 14 so as to extend slightly towards the rear portion of the bicycle 10.

A structurally strong main support tube 20 is joined to and extends upwardly from the rearward portion (or end) of the base longitudinal tube 14. The support tube 20 intersects with and is joined to an upper portion of the front support tube 18.

A rear support tube 22 is joined to and extends upwardly from an intermediate section of the main support tube 20. Preferably, the rear support tube 22 extends upwardly from the base longitudinal support 14 in a direction generally parallel to the front support tube 18. An optional auxiliary support tube 24 extends between the rear support tube 22 and the main support tube 20 to provide additional structural strength, if desired. It should be understood, of course, that the configuration of the frame of the present embodiment could vary without departing from the scope of the present invention but that the herein above disclosed configuration is considered as a preferred embodiment of the invention.

At least the upper end segment of the rear support tube 22 is, typically, hollow so as to slidably receive a correspondingly shaped seat tube (or Bar) 28 therein. In a preferred embodiment of the present invention, a seat height adjustment device 146 permits the complete adjustability of tube 28 relative to tube 22 for fine-tuning of the height positioning between the seat 34 and the base 12. The height adjustment device 46 is described in greater detail relative to FIGS. 4 and 5.

A suitable bicycle seat 34 is mounted on the horizontal seat adjustment plate 30 which is rigidly mounted to an upper end segment of the seat tube 28. The horizontal seat adjustment plate 30 and mechanism 136 is described in greater detail infra relative to FIGS. 2 and 3.

The stationary bicycle 10 also includes a handle bar tube 60 slidably inserted within a corresponding hollow section of the front support tube 18. A handle bar 62 is mounted to the handle bar tube 60. A feature of the present invention is the handle bar vertical height adjustment device or apparatus 64 using components similar to the seat height adjustment and described in greater detail infra relative to FIGS. 4 and 5. Likewise, the handle bar mechanism includes a horizontal adjustment mechanism 166 shown in greater detail in FIGS. 6 and 7.

A drive mechanism 68 is mounted on the frame of the exercise bicycle 10 preferably adjacent the intersection between the rear support tube 22 and the main transversal support 20. The drive mechanism 68 includes pedals 70 mounted to respective pedal cranks 72. The cranks 72 are, in turn, mechanically coupled to a drive mechanism gear 81 which is partially hidden from view by a guard plate 76. The pedal cranks 72 are mechanically coupled to a bottom bracket 78, which is joined within the walls of the mounting structure, as is well known in the art. Thus, the drive gear 81 turns in response to the pedaling action exerted on the pedal cranks 72.

A flywheel 80 is rotationally mounted to the frame. preferably through the use of a flywheel axle 182. The flywheel 80 is designed to -provide the rider with the feel of riding a real bicycle. Preferably, the flywheel 80. is precision machined instead of being, die-cast, as is often the case with prior art devices. Likewise, the flywheel 80 is precision balanced instead of being weighted, as is often the case with prior art devices. Typically, the flywheel has an outer diameter substantially in the range of 14' and a weight approximately in the range of 44 lb. The precision flywheel approximates the momentum of the moving bicycle and rider to provide smooth performance of the drive system and to prevent jerky motion between the high torque pedal position, i.e., when the pedals are horizontally level with one another, and low torque pedal position, i.e., when one pedal is in its uppermost position and the other pedal is in its lowermost position.

In a preferred embodiment of the present invention, the drive mechanism link between the driving gear 81 and the flywheel 80 preferably takes the form of a reinforced, steel-belted, kevlar belt 82 instead of the chain found on most conventional prior art exercise bicycles. The reinforced steel-belted kevlar belt 82 is provided with a plurality of notches 82A formed integrally therein for mechanically engaging corresponding mechanical components on both the driving gear 81 and the hub of the flywheel 80. The use of a reinforced steel-belted kevlar belt 82 provides longer lasting, stretch resistant characteristics. Moreover, belt 82 is more resistant to wear, is rust proof and is relatively unbreakable, thus, reducing the required amount of maintenance and repairs associated with conventional chains of prior art devices.

Another feature of the present invention resides in the use of a specifically designed load varying means 84 for varying the load or the amount of force necessary to turn the flywheel 80. The load varying means 84 is shown in greater details in FIG. 8.

In a preferred construction, the overall frame 10 is made out of stainless steel and cold forged, semi-tempered, seamless steel instead of the standard forged steel with welds used for the frame of most conventional stationary bicycles. Furthermore, the frame is adapted to be coated with an electronic paint instead of the conventional coating with powder coat paint. This technique provides for a stronger, sweat resistant and chip resistant finish. Typically, the width of the base transversal beam 16 is in the range of about 22' and a length of base 14 is in the range of about 42'. Also, the height of the seat 34 and handlebar 62 in the retracted configuration is in the range of about 35'. These dimensions are suggested but are not limitative.

Figure 2:
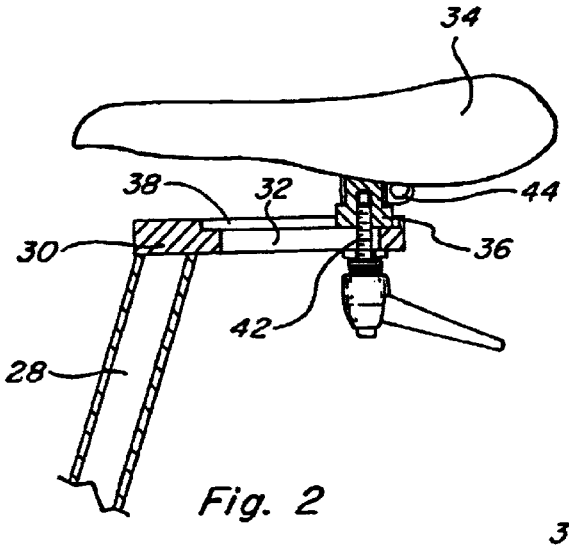
FIG. 2 is an enlarged, partially sectional view of a horizontal seat adjustment mechanism which forms a part of the stationary bicycle shown in FIG. 1.
Figure 3:
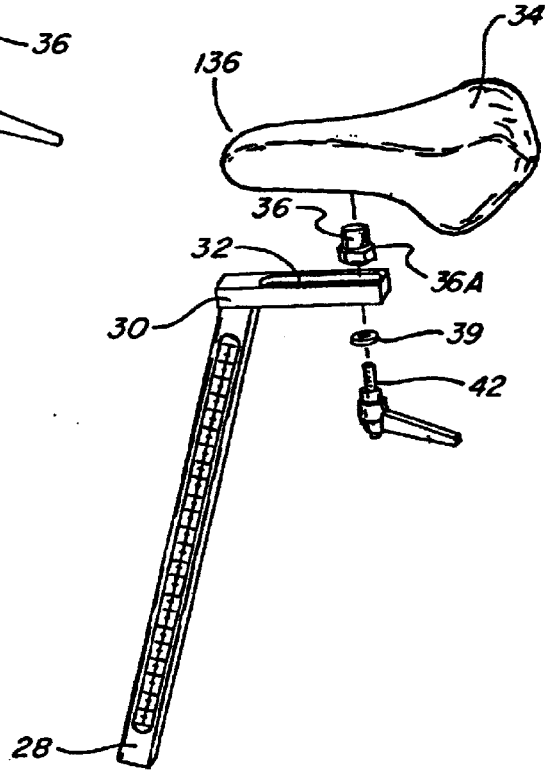
FIG. 3 is an enlarged, partially exploded view of a the horizontal seat adjustment mechanism which forms a part of the stationary bicycle shown in FIG. 1.

Referring concurrently now to FIGS. 2 and 3, there is shown in great detail one of the features of the present invention, i.e., a seat horizontal adjustment mechanism 136. The mechanism shown in FIG. 2 permits adjustment of the horizontal relationship of the seat 34 relative to the vertical seat tube 28. The horizontal seat adjustment mechanism 136 preferably includes a seat adjustment plate or support 30 having an adjustment plate slot 32 extending therethrough. The seat 34 is attached to a seat shoe 36 which is configured and sized so as to be slidably mounted within a guiding slot 38 formed on the upper surface of the plate 30. Typically, one end of the seat shoe 36 includes at least one flat side 36A to properly position the shoe in the guiding slot 38. This arrangement provides for horizontal (fore and aft) adjustment of seat position. A quick release mechanism or handle 40 having a locking pin 42 extending through the slot 32 is adapted to be used for locking the shoe 36 in a predetermined position within the slot 38. That is, the pin 42 is, typically, threadedly attached to seat shoe 36. A washer 39 may be used for spanning the slot 32, if desirable. The quick release mechanism 40, thus, allows for fine tuned horizontal positioning of the seat 34 relative to the seat tube 28. A conventional hinge 44 comprising an adjustable screw and nut combination allows for tilt adjustments of the seat 34, as is well known in the art.

Figure 4:
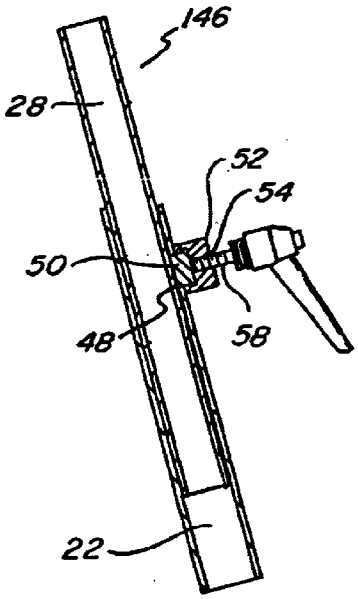
FIG. 4 is an enlarged, partially sectional view of a vertical adjustment mechanism for the seat or the handle bars each of which form a part of the stationary bicycle shown in FIG. 1.
Figure 5:
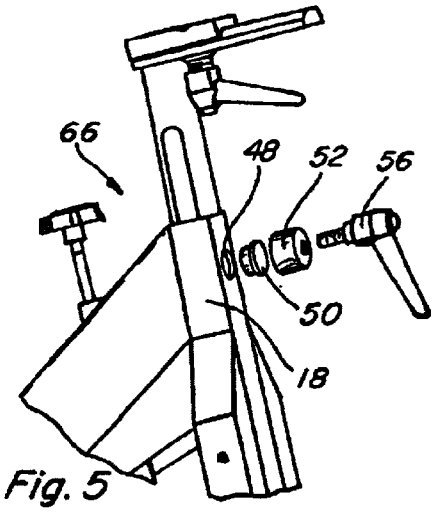
FIG. 5 is an exploded view of the vertical adjustment mechanism for the handle bars portion of the stationary bicycle shown in FIGS. 1 and 4.

Referring concurrently now to FIGS. 4 and 5, there is shown a preferred embodiment, respectively, of the seat height adjustment device or apparatus 46 or the handle bar vertical adjustment means or apparatus 64 in greater detail. The respective seat and handle bar height adjustment devices 46 preferably includes an aperture 48 formed in the rear support tube 22 (or support tube 60 in the case of the handle bar adjustment) for receiving a frictional abutment component such as a bushing 50 adapted to frictionally engage the outer surface of the seat tube 28 or front support tube 18. The bushing 50 is preferably made out of a relatively ductile material such as brass while the support component 52 is preferably made out of stainless steel or the like. The adjustment support component 52 which has an aperture 54 formed therein is mounted on the rear support tube 28 or on the front support tube 18. A quick release handle 56 having an abutment pin 58 connected to the abutment bushing 50, for example by threads, is mounted on the adjustment support component 52. The quick release handle 56 is, thus, adapted to permit, by rotation thereof, for fine tuned, releasable locking of the seat tube 28 within the rear support tube 22. The same type of adjustment mechanism can be used to adjust the height of the handle bars 62. In this case, the quick release mechanism 64 permits adjustment of tube (or bar) 60 in the upright tube 18.

Figure 6:
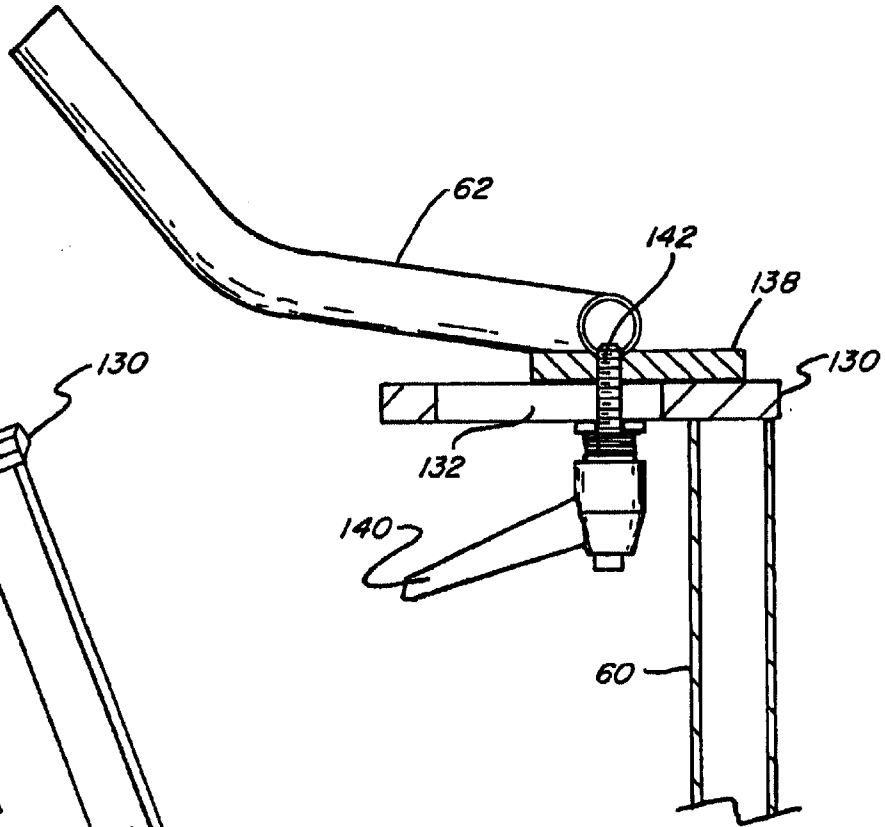
FIG. 6 is an enlarged, partially sectional view of the horizontal bar adjustment mechanism which forms a part of the stationary bicycle shown in FIG. 1.
Figure 7:
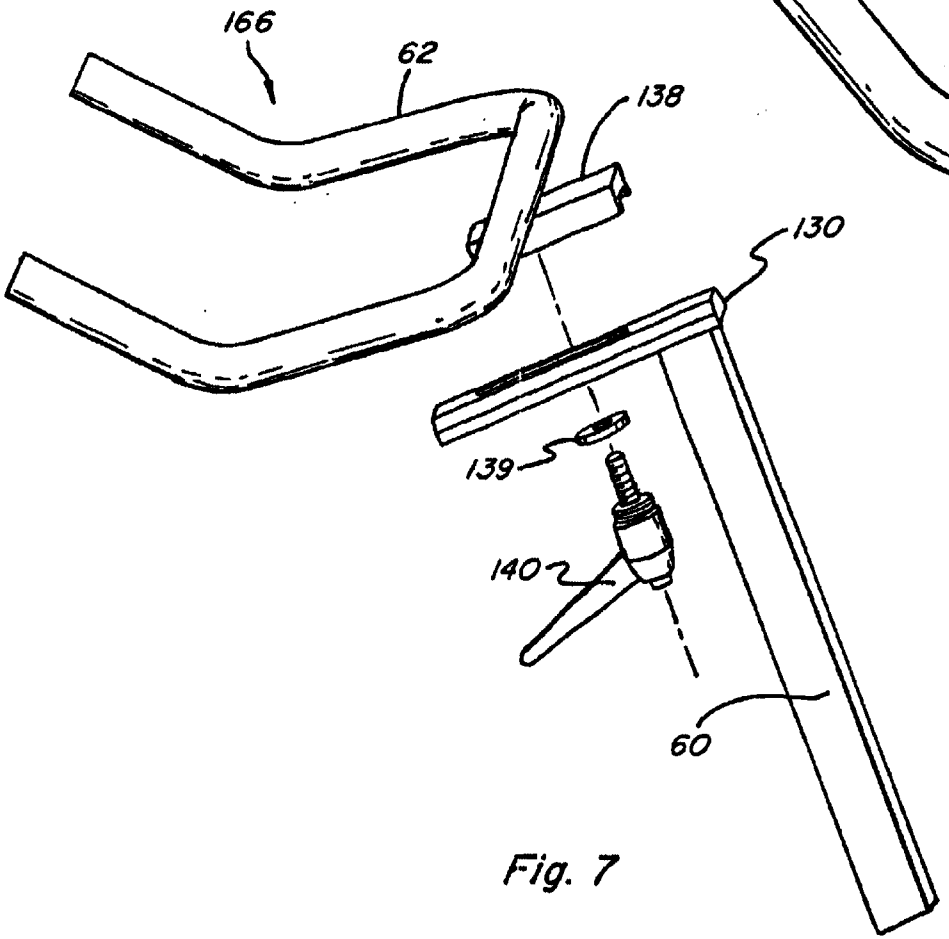
FIG. 7 is an exploded view of the handle bar horizontal adjustment mechanism shown in FIG. 6.

Referring concurrently now to FIGS. 6 and 7, there is shown in greater detail the handle bar horizontal adjustment means 66 for fine adjustment of the relative horizontal positioning between the handle bar 62 and the handle bar tube 60. The handle bar horizontal adjustment mechanism 66 is somewhat similar to the seat horizontal adjustment means 136 (See FIGS. 1–3) except that it is used for releasable locking of the handle bar tube 60 inserted within the front support tube 18 in a finely tuneable (or adjustable) predetermined relationship relative to each other. The main difference between the handle bar horizontal adjustment means 66 and the seat adjustment means 136 is that the handle bar 62 is mounted to the handlebar component 138 instead of a seat component. Similarly, the handle bar horizontal adjustment means 66 allows for precision fine-tuned horizontal adjustment of the positioning of components relative to each other.

A horizontal handlebar support 130 is attached to the handlebar tube 60 as shown in FIG. 7. The handle bar horizontal support 130 has a longitudinal groove 132 cut therein. The handlebar component 138 has a threaded hole therein adapted to receive threaded shaft 142 of the quick release handle 140. A quick-release handle 140 has a threaded shaft 142 for threadedly engaging the handlebar component 138. The handlebar component 138 has lower parallel beveled edges corresponding to the upper parallel beveled edges of the handlebar horizontal support 130 as shown in FIG. 7.

Support for this language can be found in the Original Specification, Drawing FIGS. 4 and 5.

Figure 8:
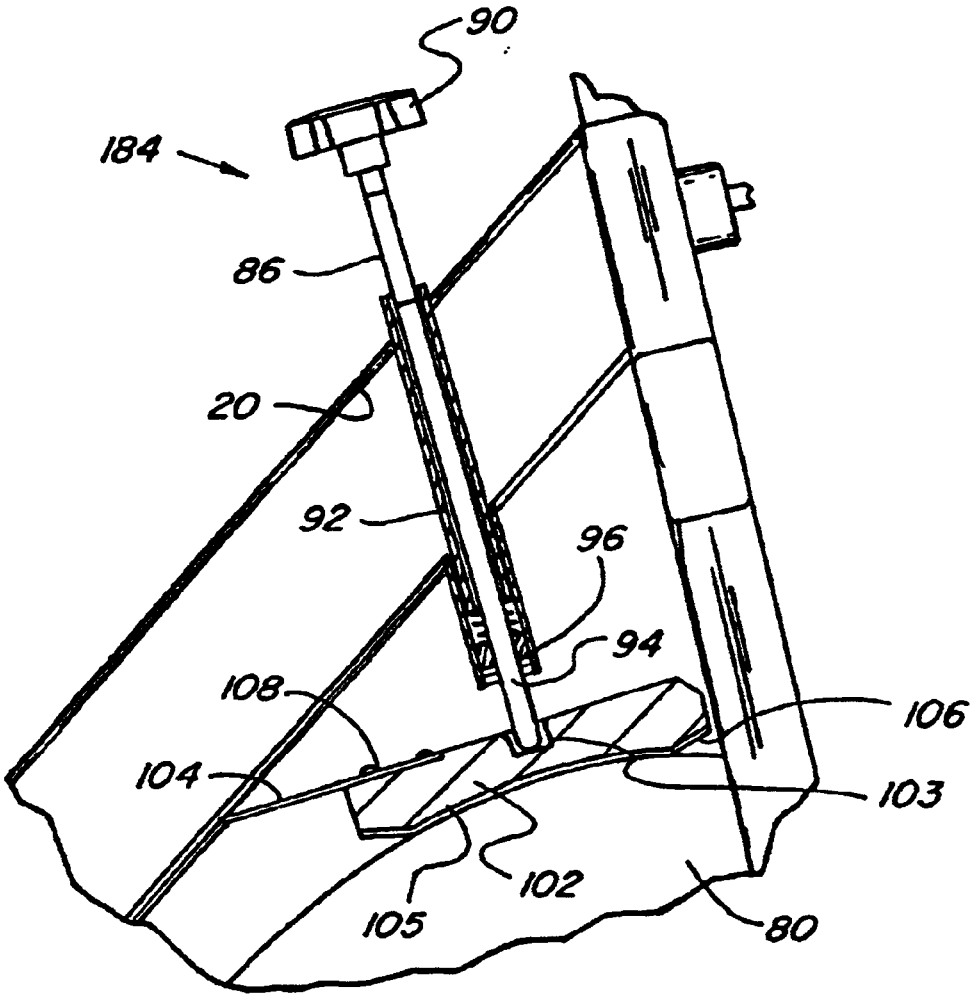
FIG. 8 is an enlarged, partially sectioned view of the load creating mechanism which forms a part of the stationary bicycle shown in FIG. 1.

Referring now to FIG. 8, there is shown in greater detail, in a partially sectioned view, one embodiment of the load varying unit 84. In this embodiment, the tensioning rod 86 is preferably made out of relatively rigid material such as stainless steel. The tensioning rod 86 has a tension knob 90 threadedly mounted at the proximal end thereof. The distal end of rod 86 is pivotally mounted in a groove or cavity 103 in the upper surface of the pad 102. A distal section 94 of the tension rod 86 passes through and is in a proximal relationship with the resilient washer 96. The wheel abutment pad 102 is mounted to the frame 10, typically to a segment of the main support tube 20, by a pad mounting device such as a flexible rod 104. The abutment pad 102 is preferably made out of a relatively light, rigid material such as anodized aluminum. An abutment surface of the abutment pad 102 is provided with a layer 105 of high coefficient of friction such as patent leather. The layer 105 is preferably mounted to the interior surface of pad 102 using conventional fastening means such as screws 106, thus, allowing for easy replacement of the lining layer 105 when needed. Similarly, the pad 102 is preferably mounted to the strap 104- using conventional fastening components such as screws 108 for ease of replacement.

In use, rotation of the knob 90 allows for adjustment of a surface pressure and, thus, of the surface coefficient of friction between the layer 105 and the circumferential edge surface of flywheel 80. Furthermore, the specific construction of the load creating means allows for an emergency braking function merely requiring that the user press downwardly on the knob 90. To release the braking action the user merely needs to pull upwardly on the knob 90. The resilient washer 96 provides a resilient biasing force tending to bias the lining 105 against the flywheel 80 thus further enhancing the provision for a smooth ride.

Thus, there is shown and described a unique design and concept of stationary exercise bicycle. While this description is directed to a particular embodiment, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

What is claimed is:

1. An adjustable exercise bicycle, comprising:

(a) a frame, said frame supporting and attached to a seat, handlebars and a flywheel, also comprising pedals rotatably attached to said frame and operatively connected to said flywheel;

(b) an adjustable abutment pad mechanically in contact with said flywheel;

wherein said frame further comprises a rear support tube adapted to receive a seat tube, said seat tube slidably located in said rear support tube;

a seat adjustment support component attached to said rear support tube at a rear support tube aperture;

an abutment bushing, said abutment bushing comprising an upper head flange and a lower bushing shaft, said bushing adapted to be inserted inside said seat adjustment support component, wherein said flange prohibits said bushing from going through said rear tube aperture; and a quick-release lever having a handle and a threaded abutment pin, wherein said threaded pin is adapted to be threadedly inserted into said seat adjustment support component;

wherein said seat tube may be vertically adjustably secured inside of said rear support tube by said lever and tightening said bushing.

2. An adjustable exercise bicycle, comprising:

(a) a frame, said frame supporting and attached to a seat, handlebars and a flywheel, also comprising pedals rotatably attached to said frame and operatively connected to said flywheel;

(b) an adjustable abutment pad mechanically in contact with said flywheel;

wherein said seat is attached to a seat shoe having a threaded hole therein;

further comprising a horizontal seat adjustment plate attached to a seat tube, said seat adjustment plate having a seat adjustment slot therein adapted to slidably receive said seat shoe;

a quick-release mechanism having a threaded locking pin, wherein said threaded locking pin is adapted to be threadedly inserted into said threaded seat shoe hole;

wherein said seat is horizontally slidably adjustable in said seat base seat adjusting slot.

3. An adjustable exercise bicycle as in claim 2, wherein said seat shoe has at least one flat side and said wherein said seat adjusting slot has at least one flat side corresponding to the flat side of said seat shoe.

4. An adjustable exercise bicycle as in claim 2, wherein said seat adjusting slot has a recessed guiding slot adapted to receive the lower portion of said seat shoe.

5. An adjustable exercise bicycle, comprising:

(a) a frame, said frame supporting and attached to a seat, handlebars and a flywheel, also comprising pedals rotatably attached to said frame and operatively connected to said flywheel;

(b) an adjustable abutment mechanically in contact with said flywheel;

wherein said handlebars are attached to a handlebar seat horizontal adjusting means having a threaded hole therein;

further comprising a handlebar horizontal support attached on top of a handlebar tube, said handlebar support having a longitudinal groove therein;

a quick-release handle having a threaded shaft, wherein said threaded shaft is adapted to be threadedly inserted into said hole of the handlebar seat horizontal adjusting means;

wherein said handlebars are horizontally slidably adjustable in said longitudinal groove of said handlebar support.

6. An adjustable exercise bicycle as in claim 5, wherein said handlebar seat horizontal adjusting means has lower beveled parallel edges and wherein said handlebar horizontal support has corresponding upper beveled parallel edges.

7. An adjustable exercise bicycle as in claim 5, wherein said adjustable abutment comprises a pad having a lower surface made of patent leather.

* * * * *